US005298887A

United States Patent [19]

Pepping

[11] Patent Number: 5,298,887

[45] Date of Patent: Mar. 29, 1994

[54] MOLTEN METAL GAUGING AND CONTROL SYSTEM EMPLOYING A FIXED POSITION CAPACITANCE SENSOR AND METHOD THEREFOR

[75] Inventor: Roger A. Pepping, Tempe, Ariz.

[73] Assignee: Sentech Corporation, Tempe, Ariz.

[21] Appl. No.: 771,210

[22] Filed: Oct. 4, 1991

[51] Int. Cl.[5] ..... G08B 21/00

[52] U.S. Cl. ..... 340/618; 340/603; 164/449; 164/450; 73/290 R

[58] Field of Search ..... 340/618, 622, 623, 603; 164/150, 154, 449, 450; 73/295, 304 C, 290 R

[56] References Cited

U.S. PATENT DOCUMENTS

| | | | |
|---|---|---|---|
| 3,668,386 | 6/1972 | Blecherman et al. . | |
| 3,738,419 | 6/1973 | Hartmann et al. | 164/281 |
| 3,783,932 | 1/1974 | Crowell et al. | 164/4 |
| 3,946,795 | 3/1976 | Bruderer et al. | 164/154 |
| 4,075,890 | 2/1978 | Iwasaki et al. | 73/295 |
| 4,112,759 | 9/1978 | Mizuno et al. | 73/295 |
| 4,126,041 | 11/1978 | Doi et al. | 164/150 X |
| 4,132,259 | 1/1979 | Poncet | 164/449 X |
| 4,175,612 | 11/1979 | Baumert | 164/449 |
| 4,186,792 | 2/1980 | Yamada et al. | 164/150 |
| 4,202,398 | 5/1980 | Osugi | 164/150 |
| 4,392,523 | 7/1983 | Beller et al. | 164/453 |
| 4,470,446 | 9/1984 | Kamikawa et al. | 164/451 |
| 4,498,521 | 2/1985 | Takeda et al. | 164/453 |
| 4,567,935 | 2/1986 | Takeda et al. | 164/450 |
| 4,573,128 | 2/1986 | Mazur | 73/295 X |
| 4,580,449 | 4/1986 | Hatono et al. | 73/290 R |
| 4,647,854 | 3/1987 | Yamada et al. | 164/449 X |
| 4,774,999 | 10/1988 | Kraus | 164/449 X |
| 4,899,994 | 2/1990 | Zhidkov et al. . | |
| 5,103,893 | 4/1992 | Naganuma et al. | 164/150 |

*Primary Examiner*—Jeffery A. Hofsass
*Attorney, Agent, or Firm*—Nilsson, Wurst and Green

[57] ABSTRACT

Two embodiments of a molten metal gauging and control system using a fixed position capacitance sensor and methods therefor are disclosed. The first embodiment discloses a molten metal gauging system, the output of which can be used by various different external control systems to adjust the flow of molten metal appropriately. The second embodiment discloses a molten metal gauging and control system that comprises the molten metal gauging system of the first embodiment in conjunction with a tapered pin positioner system as the element to control the flow of molten metal.

79 Claims, 7 Drawing Sheets

MOLTEN METAL GAUGING AND CONTROL SYSTEM EMPLOYING A FIXED POSITION CAPACITANCE SENSOR AND METHOD THEREFOR

FIELD OF THE INVENTION

The invention generally relates to systems for gauging and controlling molten metal and methods therefor, and relates more specifically to a system for gauging and controlling molten metal using a fixed position capacitance sensor and method therefor.

DESCRIPTION OF THE PRIOR ART

The prior art molten metal gauging system uses two classes of gauges, contact gauges and non-contact gauges. Contact gauges are float devices designed to float on top of the molten metal. These float devices generally have a fixed shaft which actuates a measurement device coupled thereto. U.S. Pat. Nos. 4,567,935 and 4,498,521 disclose a system and method for molten metal level control in continuous casting using this type of float device which actuates a displacement transducer. Common measurement devices (transducers) for use with float devices include variable resistors (potentiometers), Linear Variable Differential Transformers (LVDTs), and inclinometers. Potentiometers and inclinometers are prone to errors related to temperature drift and contamination. Potentiometers further do not provide the high level of accuracy required by many molten metal applications, and may degrade in performance over time. Inclinometers are prone to errors related to vibration. Potentiometers, LVDTs and inclinometers all suffer from inaccuracies caused by the mechanical linkage required to couple the measurement device to the float. This mechanical linkage may have bearings, shafts, bushings and related hardware that wear over time and induce errors.

Float systems suffer from other disadvantages as well. The mass of the float reduces the speed of the response of the float to changing molten metal levels. In order to move in response to a change in molten metal level, the float must overcome the initial friction of the mechanical linkage and measurement device. This friction creates a hysteresis effect in the measurement signal. The mechanical linkage used to couple the float to the measurement device is subject to mechanical damage, excessive friction, and misalignment which can cause errors. The float itself can deteriorate in performance with age by absorbing metal or other materials, causing measurement errors. Due to the mechanical linkage associated with float systems, these systems are generally difficult to calibrate, and require relatively frequent adjustment or recalibration. In addition, the float type system may not be mounted directly to the container where the molten metal level is measured. In this case the mounting structure may expand differently when heated compared to the container itself, causing errors in measurement.

Non-contact gauges have been used to overcome many of the problems related to the mechanical limitations of the contact gauging systems. These types of gauges include capacitance sensors and inductance sensors. Inductance sensors have a limited measurement range, and are subject to errors caused by temperature changes. In addition, inductance sensors are sensitive to the permeability of the metal being measured, making the measurement of a number of different alloys with the same inductive sensor difficult without calibrating the inductive sensor to each different alloy. Capacitance sensors are sensitive to capacitive interference caused by surrounding objects.

Both capacitance and inductance sensors have outputs that are non-linear with respect to distance from the molten metal level. For this reason both capacitance sensors and inductance sensors are often mounted on servo mechanisms which move the sensor in response to changing molten metal levels to keep the sensor a distance from the molten metal where the output is assured to be relatively linear. The mechanical linkage coupling the sensor to the servo mechanism suffers from the same drawbacks mentioned in regard to the mechanical linkages used with float (contact) sensors. In addition, the motor, controller, sensor and feedback controller circuits are sensitive to excessive heat, and are therefore usually mounted as far as practical from the molten metal, and not on the molten metal container itself. The mounting structure for the sensor and servo mechanism expands differently due to temperature variations when compared to the molten metal container, introducing errors in the gauging system.

The servo-driven sensor gauging systems mentioned above suffer from other disadvantages. Objects near the sensor that are uniform in size and distance over the entire range of sensor motion may introduce a small offset which can be easily sensed and accounted for during sensor calibration. However, since the sensors are mounted on a servo system which moves the sensors with respect to the molten metal, there exists a possibility of objects that are not uniform in size and distance over the range of sensor motion interfering with sensor readings. In addition, the speed of response of the sensor system is limited to the maximum motor speed as determined by the motor controller. The motor controller may introduce errors in the measurement signal due to overshoot or undershoot when positioning the sensor. Due to the complexity of the system, calibration of the system is difficult. The complexity of the system may lead to reliability problems. And these systems are generally expensive.

Other systems have been previously developed which use either capacitance or inductance sensors fixedly mounted to the molten metal container, thereby eliminating the drawbacks associated with mechanical linkages and movable parts. U.S. Pat. No. 3,783,932 discloses a method for controlling molten metal height in continuous casting using a fixed-position inductance sensor. As mentioned above, inductance sensors suffer from inaccuracies due to changes in coil temperature and changing permeability of different alloys. The capacitance sensor is sensitive to interference objects, but the errors introduced by interference objects can be minimized by carefully selecting the mounting location of the sensor. In this regard, the capacitance sensor is preferable to the inductance sensor. The primary disadvantage of both these types of systems is a non-linear output that limits the effective measurement range of the sensor. The practical range that is mostly linear, and therefore directly usable by the molten metal control system, is limited to a range that is not generally practical in today's molten metal manufacturing systems.

Other non-contact gauging systems for molten metal include optical ranging systems which use a laser light source to measure molten metal using trigonometric techniques. These systems are complex and expensive, and subject to problems related to mounting position, thermal expansion of the mounting different than the thermal expansion of the molten metal container, and vibration. Ultra-sonic systems have also been used with limited success due to the high ambient temperatures and changes in air density which affect measurement accuracy. Many other systems utilizing a variety of techniques for measuring and controlling molten metal levels are disclosed in the following U.S. Pat. Nos.: 4,186,792; 4,899,994; 4,580,449; 4,470,446; 4,392,523; 4,202,398; 4,132,259; 4,126,041; 4,112,759; 4,075,890; 3,946,795; 3,738,419; 3,668,386; and 4,573,128.

The output of the molten metal gauging system is generally used by the molten metal control system to adjust the level of molten metal appropriately. In one specific implementation of a molten metal control system, a tapered pin is the control element, and the flow of molten metal into the trough or container is controlled by positioning the tapered pin into a tapered hole through which the molten metal flows. There are presently three methods used commercially to position the tapered pin in response to the changing molten metal level to thereby control the flow, and hence the level, of molten metal.

The first method for positioning the tapered pin uses a mechanical linkage from a float type gauge connected through a series of levers supported by bearings to a pin with a tapered portion at the end to fit a corresponding tapered hole in the metal container. As the float moves, the tapered pin moves a predetermined amount based on the mechanical advantage provided by the connecting levers. The movement of the tapered pin modulates the flow of molten metal. This system is subject to errors caused by the mechanical linkage as explained for the case of the float (contact) gauging systems above. The resistance and hysteresis of the mechanical linkage may cause errors. In addition, the mechanical type system is difficult to calibrate and adjust.

The second method for positioning the tapered pin is to actuate the tapered pin using an air cylinder or diaphragm coupled to the tapered pin using a lever system. The air cylinder or diaphragm is controlled by the output of the gauging control system using typically a transducer that converts current to pressure in the air cylinder or diaphragm. This type of positioning system is often open loop in that there is generally no feedback to determine that the tapered pin actually moved to the appropriate distance. The only feedback is in the form of a changing molten metal level in the container, making for a positioning system that responds very slowly to changes in molten metal level. In addition, the air in the cylinder or diaphragm acts like a spring, making proper damping of the tapered pin positioning system difficult.

The third method for positioning the tapered pin is to use an electrical motorized assembly that translates rotary motion of the positioning motor to linear motion of the tapered pin. This rotary to linear translation is accomplished using typically belt or gear reducers combined with lead screw actuators. These types of electrical motorized assemblies typically incorporate a resistance type sensor to feed back to the motor controller the position of the tapered pin to assure accurate positioning. The electrical motorized pin positioning systems are generally much more accurate than the mechanical linkage systems or the air cylinder or diaphragm systems. However, the electrical motorized pin positioning systems are generally quite complex, have high power requirements and are sensitive to heat. Due to the sensitivity to heat, many systems are mounted as far from possible from the molten metal, coupling the tapered pin to the linear actuator using extension arms. These extension arms cause significant side loading on the linear actuator, causing rapid wear in the linear actuator.

Therefore, a need existed to provide a simple, reliable, low-cost gauging and control system for molten metal using a fixed position capacitance sensor that has a measurement range sufficient for most molten metal gauging applications. The gauging system would have no moving parts, and the molten metal control system would be more accurate, less subject to heat degradation, and less sensitive to side loading as the prior art systems. The subject gauging system could be used to detect the level of molten metal at any point in the molten metal process, wherever the need to measure the level of the molten metal exists. In one specific application, the subject gauging system could be used for sensing the level of metal in a trough or launder which feeds a continuous casting apparatus. The level of metal sensed in the trough is communicated to the portions of the casting apparatus which control the rate of flow of metal into the trough, and a gate or valve controlling the metal flow out of the trough into the continuous caster is adjusted to maintain the molten metal at the desired level.

SUMMARY OF THE INVENTION

It is an object of this invention to provide a molten metal gauging system and method therefor that has a sensor with no moving parts or complicated mechanical linkages.

It is another object of this invention to provide a molten metal gauging system having a fixed position capacitance sensor mounted directly to the molten metal container and method therefor.

It is a further object of this invention to provide a molten metal gauging system and method therefor having a modular type architecture.

It is yet another object of this invention to provide a molten metal gauging system using a fixed position capacitance sensor which provides means to linearize the output of the capacitance sensor to thereby extend its useful measurement range.

It is still further object of this invention to provide a molten metal gauging system using a fixed position capacitance sensor which includes a simplified operator interface having extensive error detection and status reporting.

It is yet another object of this invention to provide a molten metal gauging and control system using a fixed position capacitance sensor which has a control element to control the flow or level of molten metal in response to the level output of the gauging system.

BRIEF DESCRIPTION OF THE PREFERRED EMBODIMENT

In accordance with the first embodiment of the present invention, a molten metal gauging system is provided. This system comprises a sensor assembly coupled to a remote controller or converter unit identified herein as a transmitter. The transmitter is coupled to a display system allowing the operator to monitor the status of the gauging system. The display system also provides inputs to certain function features of the system.

The sensor used is a capacitance sensor which provides a digital frequency output proportional to the distance between the capacitor plates. The sensor is rigidly mounted directly to the molten metal container. The sensor itself houses one plate, and has an electrical connection to the molten metal, which acts as the second plate of the capacitor. The frequency output of the capacitance sensor is an input to a transmitter which can be a remote transmitter. The transmitter converts this frequency into distance between the sensor and the molten metal, and outputs the appropriate control signals to the external control system which controls the flow of molten metal into and/or out of the molten metal container. The output of the sensor becomes increasingly non-linear as the distance between the molten metal and the sensor increases. To assure accuracy of the gauging system as the distance between sensor and molten metal increases, the transmitter translates the non-linear response of the sensor into a linear distance function between the sensor and the molten metal, thereby greatly extending the operable range of the sensor. The status of the gauging system is shown to the operator on the display terminal.

According to a second embodiment of the present invention, the gauging system is expanded to include a molten metal control system for controlling the flow of molten metal into and/or out of a molten metal container. The system uses a capacitance sensor that provides an input to a transmitter which provides an output to a display system and to the molten metal control system to adjust the flow of molten metal in response to the sensed or measured level in the container. The display system also provides inputs to the molten metal control system of various function features. Accordingly, a complete closed-loop system is provided where the molten metal level as detected by the sensor is fed back to the transmitter, which provides signals to the molten metal system to make appropriate adjustments to the molten metal level.

DESCRIPTION OF THE PREFERRED EMBODIMENTS

According to the preferred embodiment of the invention, a molten metal gauging system using a fixed position capacitance sensor is disclosed. This gauging system comprises the following elements:

1) A capacitance sensing circuit comprising an oscillator circuit with a digital frequency output proportional to the capacitance detected by two plates of a capacitor. One plate of the "capacitor" is a sensing plate on the sensor itself, with the other plate of the "capacitor" being the molten metal itself.
2) A temperature transducer mounted in close proximity to the capacitance sensing circuit.
3) A mechanical enclosure for the capacitance sensing circuit and the sensing plate, which assembly constitutes the sensor body.
4) A path within the mechanical enclosure for cooling the capacitance sensing circuit using air, water, or other gas or fluid.
5) A mounting bracket to connect the sensor body to the molten metal container.
6) A remotely located electronic controller or converter called herein a transmitter.
7) Wiring connections between the capacitance sensing circuit and the transmitter, and between the temperature transducer and the transmitter.
8) Software to control the transmitter.
9) An operator interface that is easy to use.
10) An operator interface display controller.
11) Software for the operator interface display controller.
12) A mechanical enclosure and rack unit to support and interconnect the transmitters, display controllers, and appropriate power supplies.

Figure 1:
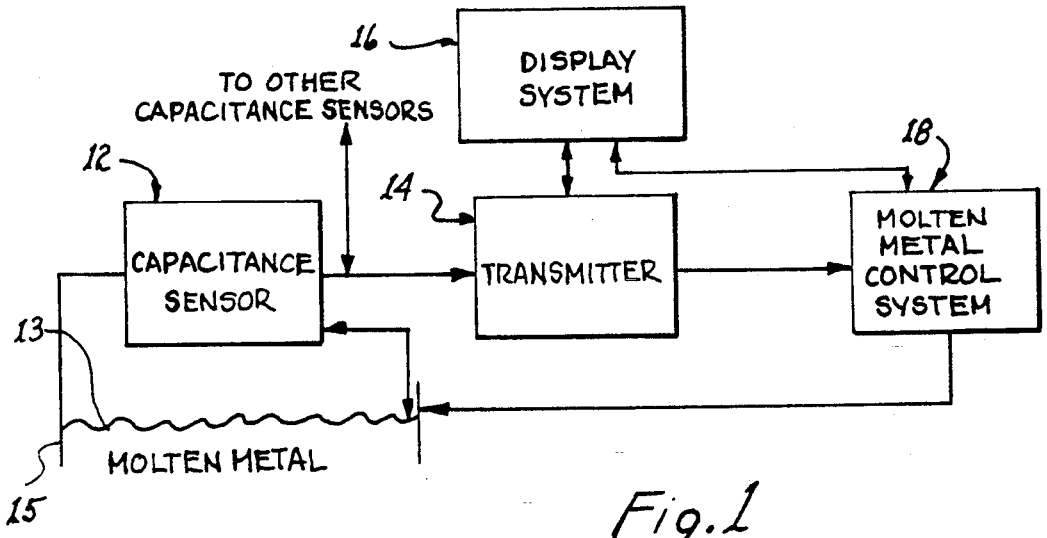
FIG. 1 is a general schematic of the molten metal gauging and control system according to the invention.

As shown in FIG. 1, a molten metal gauging and control system is disclosed. This system includes molten metal 13 within a molten metal container 15, a capacitance sensor 12, controller circuitry known herein as a transmitter 14, and a display system 16. The output of transmitter 14 is a signal that communicates molten metal level to the molten metal control system 18, which adjusts the flow of molten metal 13 into the container 15 appropriately. The first embodiment of the present invention relates to the gauging portion, comprising the molten metal 13 in a container 15, capacitance sensor 12, transmitter 14, and the display system 16. A second embodiment of the present invention relates to the entire gauging and control system, comprising the molten metal 13 in a container 15, capacitance sensor 12, transmitter 14, display system 16, and molten metal control system 18.

One possible configuration for the capacitance sensor 12 is disclosed in FIGS. 2-5. The specific configuration shown is for illustrative purposes only, and it is within the scope of the present invention to use any size, shape, or configuration of capacitance sensor 12.

Figure 2:
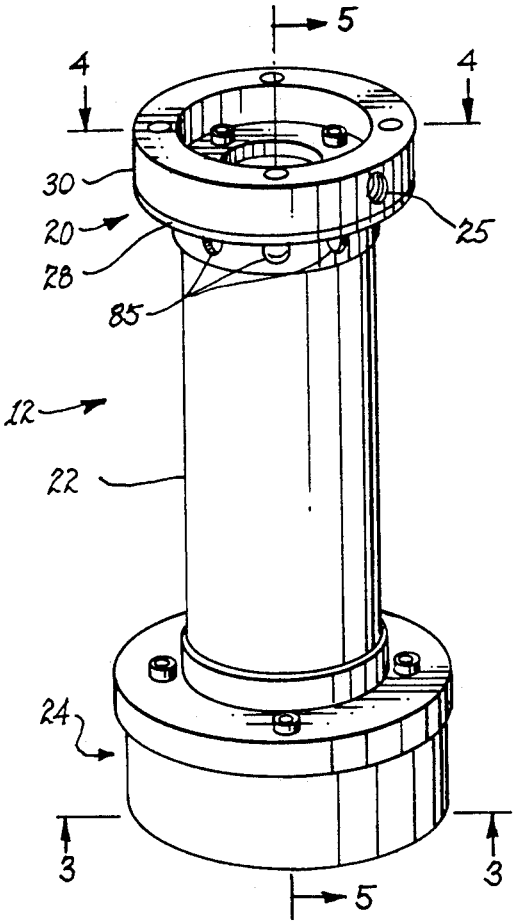
FIG. 2 is a perspective view of the capacitance sensor used in the molten metal gauging system of the present invention.
Figure 3:
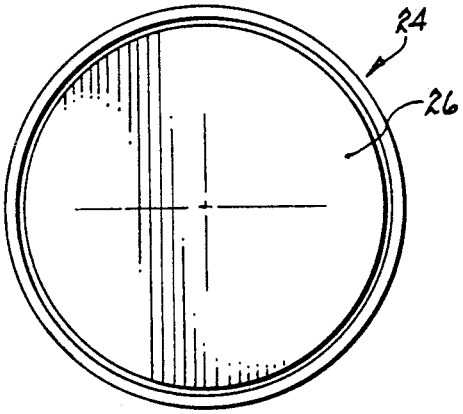
FIG. 3 is an end view of the capacitance sensor shown in FIG. 2 along the line 3—3.

The capacitance sensor 12 shown in FIG. 2 has a mounting portion 20, a body 22, and a base portion 24. FIG. 3 shows the configuration of the base portion 24. Base portion 24 houses the sensor plate 26 for the capacitance sensor 12. Sensor plate 26 is coupled to base portion 24 in such a way as to provide electrical isolation between sensor plate 26 and base portion 24, and to provide electrical continuity between sensor plate 26 and the internal circuitry which measures capacitance. In addition the internal circuitry which measure capacitance is electrically connected to body 22 by conductor 22C (see FIG. 5), which is connected to flat plate 28 and to base portion 24. In this manner the base portion 24, body 22, and flat plate 28 are all driven to the same potential as the sensor plate 26, thereby providing an electrical shield to reduce the effects of stray capacitance of nearby metal objects on the capacitance measuring circuit.

Figure 4:
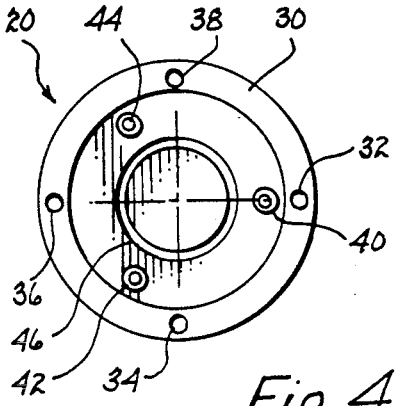
FIG. 4 is an end view of the capacitance sensor shown in FIG. 2 along the line 4—4.

As shown in FIG. 2, mounting portion 20 comprises a flat plate 28 and an insulating mounting ring 30. FIG. 4 shows the mounting portion 20 of the capacitance sensor 12 in more detail. Insulating mounting ring 30 is made of plastic or like material to provide both electrical and thermal isolation between the capacitance sensor 12 and its mounting bracket (not shown). Four holes 32, 34, 36, and 38 are provided for mounting the insulating mounting ring 3 and the flat plate 28 to the mounting bracket. Three holes are provided for screws 40, 42, and 44 to attach the insulating mounting ring 30 to the body 22 of the capacitance sensor 12. A central hole 46 passes through both insulating mounting ring 30 and flat plate 28 allowing the capacitance sensing circuitry to slide into place within the body 22 of the capacitance sensor 12.

Figure 5:
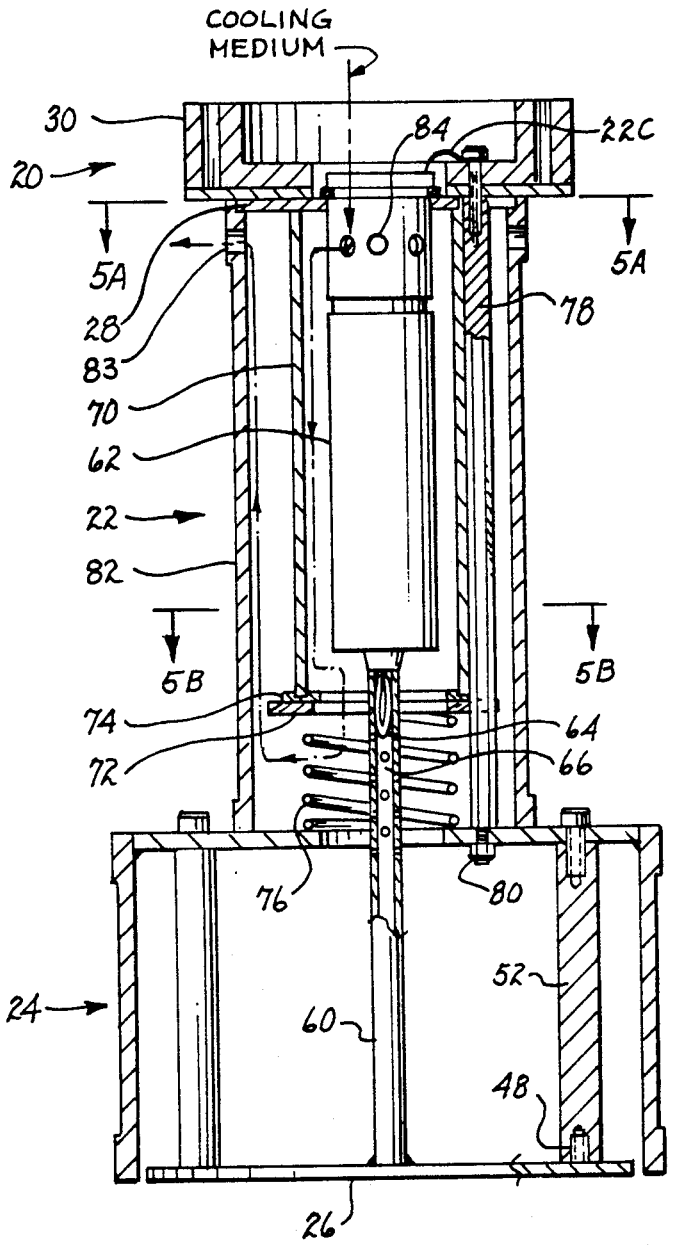
FIG. 5 is a cross sectional view of the capacitance sensor shown in FIG. 2 along the line 5—5.

The construction of capacitance sensor 12 is shown in more detail in the cross sectional view of FIG. 5. Sensor plate 26 has coupled thereto four stud posts which engage four insulating spacers. The stud posts are represented by 48 in FIG. 5, and the insulating spacers by 52. The opposite end of insulating spacer 52 is attached to the base portion 24 of the capacitance sensor 12 using screw 56 as shown. The other three insulating spacers are attached to base plate 26 and base portion 24 in like manner. Base plate 26 has rigidly mounted thereto a coupling rod 60, which provides electrical continuity between the base plate 26 and the capacitance measuring circuitry housed within cylindrical housing 62. The capacitance measuring circuitry housed within cylindrical housing 62 has a pin type connector 64 as shown. Coupling rod 60 has a corresponding socket portion 66 which couples to pin type connector 64 of cylindrical housing 62.

The capacitance measuring circuitry within cylindrical housing 62 senses the capacitance between the base plate 26 of the capacitance sensor 12 and the molten metal. The circuitry must, therefore, have an external electrical connection to the molten metal. This connection to the molten metal is accomplished by a wire cable leading from the cylindrical housing 62 to either a probe in the molten metal, or directly to the molten metal container 15.

Figure 5A:
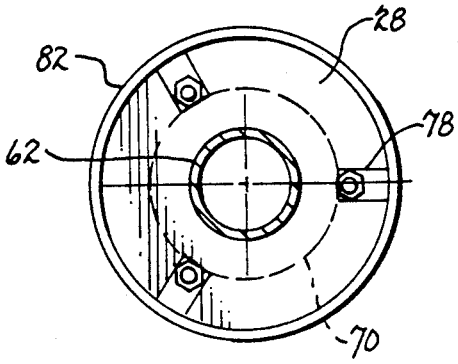
FIG. 5A is a cross sectional view of the capacitance sensor of FIG. 5 along the line 5A—5A.
Figure 5B:
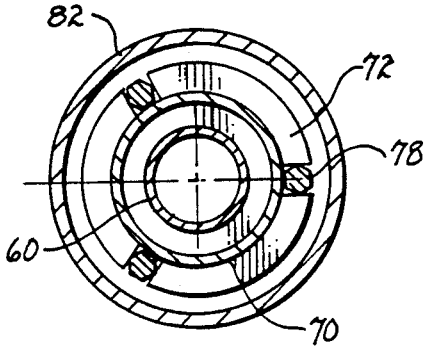
FIG. 5B is a cross sectional view of the capacitance sensor of FIG. 5 along the line 5B—5B.

The body 22 of capacitance sensor 12 comprises an outside tube 82, an inside tube 70, a bottom plate 72, a gasket 74, a spring 76, and threaded spacers 78. Three threaded spacers 78 are attached to base portion 24 using screws 80. These threaded spacers 78 also provide the three mounting points that correspond to the mounting holes 40, 42, and 44 in the insulating mounting ring 30 shown in FIG. 4. The spring 76 is placed inside the three spacers 78. Bottom plate 72 is then placed on spring 76, gasket 74 is placed on bottom plate 72, and inside tube 70 is then placed on gasket 74 as shown in FIG. 5. Attaching the mounting portion 20 to the body 22 requires depressing the spring 76 in such a way that the top edge of the flat plate 28 is the same height as outside tube 82, thereby allowing mounting portion 20 to be coupled to spacers 78. FIG. 5A shows how flat plate 28 can slide inside outside tube 82 and past the threaded spacers 78. Flat plate 28 also engages the threaded spacers 78 in such a way as to prevent turning of the spacers 78. Bottom plate 72 is shown in more detail in FIG. 5B mounted properly in place.

Note that the cylindrical housing 62 has holes 84 therein. These holes are for the purpose of passing a cooling medium such as air, gas, or liquid past the cylindrical housing 62 to keep the capacitance measuring circuitry housed therein at a reasonable operating temperature. A fitting 25 shown in FIG. 2 on the capacitance sensor 12 is used to introduce the cooling medium into the cavity of the insulating mounting ring 30. The cooling medium then passes through the holes 84 in cylindrical housing 62, proceeds downward to holes in gasket 74 and bottom plate 72, into the area occupied by the spring 76, up through the space between the outside tube 82 and inside tube 70, and out one or more exhaust ports 83. This flow of cooling medium allows the capacitance sensing circuitry housed within cylindrical housing 62 to remain at a reasonable operating temperature.

Figure 9:
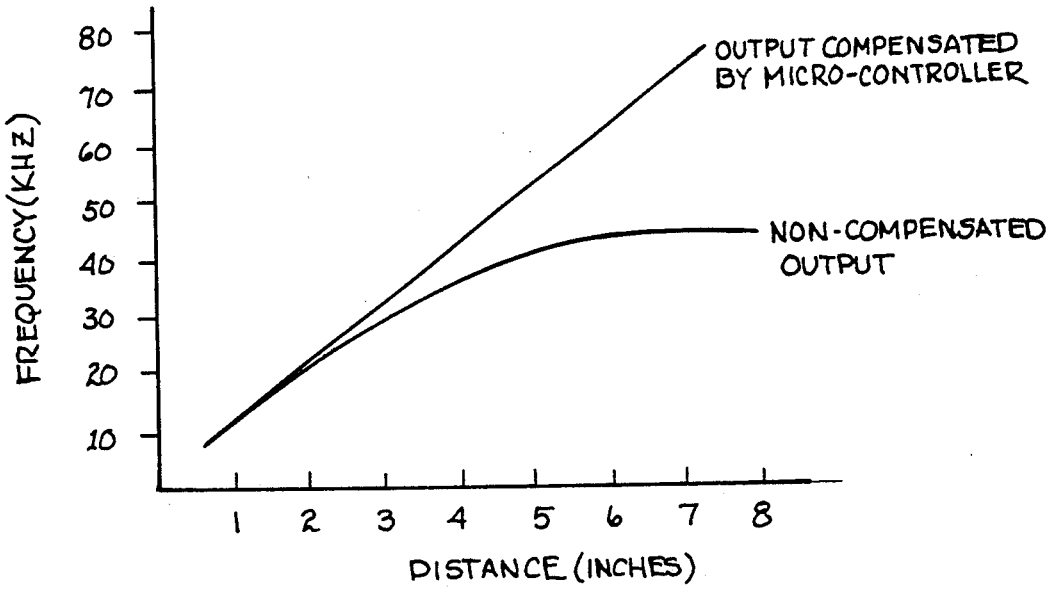
FIG. 9 is a graph showing the non-compensated output of the capacitance sensor of FIG. 2, and showing the output of the sensor after its output is compensated appropriately.

The output of the capacitance sensor 12 is shown in FIG. 9 as the lower, curved line labeled Non-Compensated Output. As this graph readily shows, the response of the capacitance sensor 12 becomes very non-linear as the distance between capacitance sensor 12 and molten metal 13 increases as a result of fringe capacitance effects and stray capacitance induced by nearby metallic objects. This non-linearity of the response of the sensor 12 can be characterized and appropriate correction factors can be computed in the control software of the transmitter 14 utilizing a simple field calibration procedure. The response of the transmitter after software correction is shown by the upper line in FIG. 9. Using software correction of the capacitance sensor 12 response, the useful range of the capacitance sensor 12 is extended dramatically, as can be seen by the difference between these two curves as the distance between capacitance sensor 12 and molten metal 13 increases.

Figure 6:
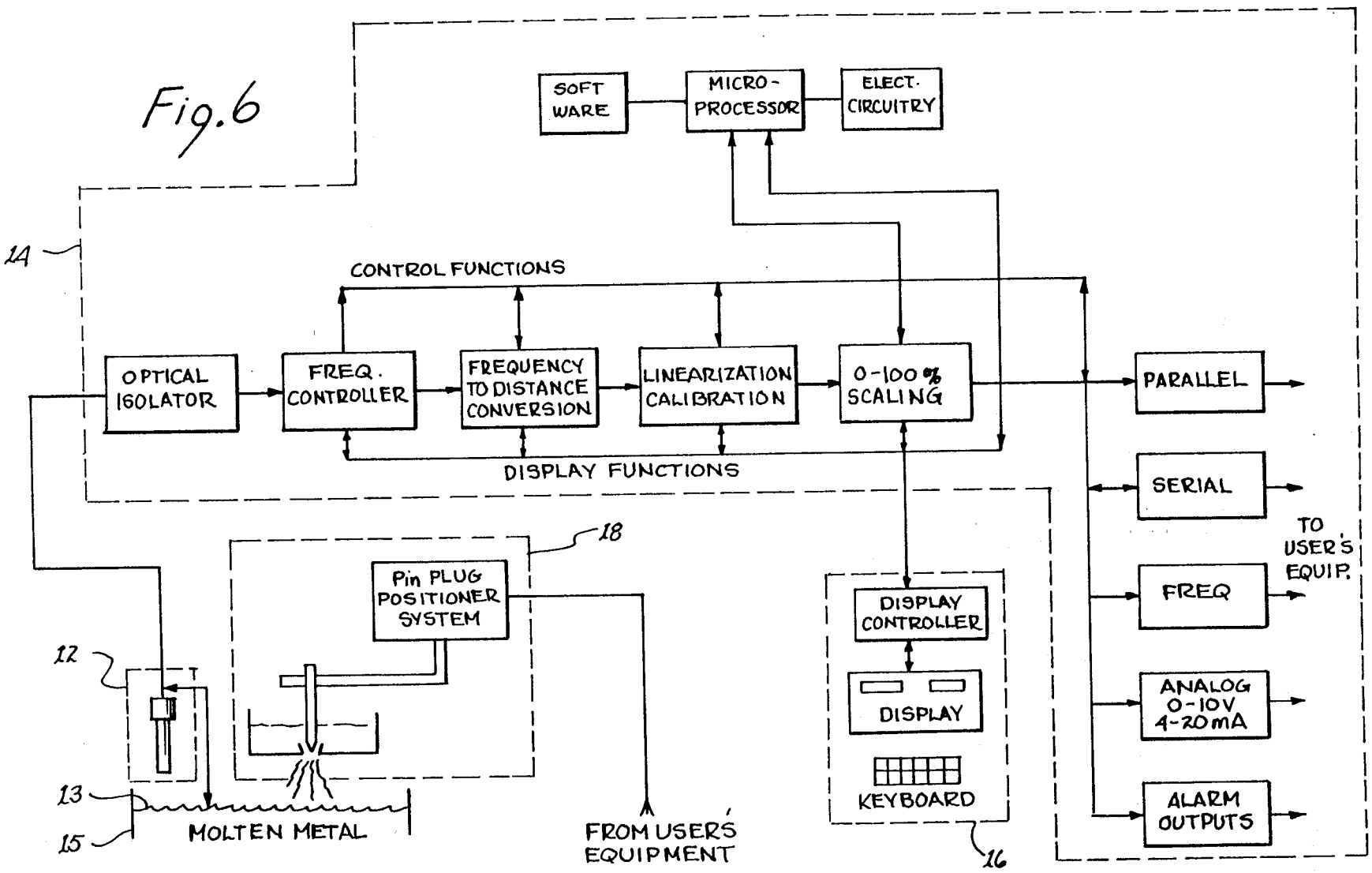
FIG. 6 is a detailed schematic view of the molten metal gauging and control system of FIG. 1.

FIG. 6 shows a more detailed schematic diagram of the general schematic diagram shown in FIG. 1 This diagram is for the preferred embodiment, wherein the pin plug positioning system is one of many different types of molten metal control systems commonly in use. The dotted lines define boxes which correspond to the functions labeled in FIG. 1. The output of capacitance sensor 12 is a digital frequency proportional to sensed capacitance, and therefore the level of the molten metal 13 in the container 15. This output is input into the transmitter 14 through an optical isolator. The transmitter counts the incoming digital pulses, filters the signal, converts the frequency to distance, provides necessary linearization, and provides a scaled 0 to 100% output corresponding to the desired molten metal level to be measured. This scaled level output may take the form of a parallel digital output, an analog voltage level, or a 4–20 mA current loop output. In addition other outputs may be provided to set off alarms if the level goes beyond specified limits. The scaled output of the transmitter is output to the display system to allow monitoring of the molten metal process by an operator. The output is also used by the molten metal control system 18, specifically illustrated in this example as a pin plug positioner system. This molten metal control system 18 adjusts the flow of molten metal 13 into the container 15 to maintain the desired level.

As shown in FIG. 6, various inputs are provided to the display control system and various outputs from the display control system are provided to the function features coupled to the display control system.

Figure 7:
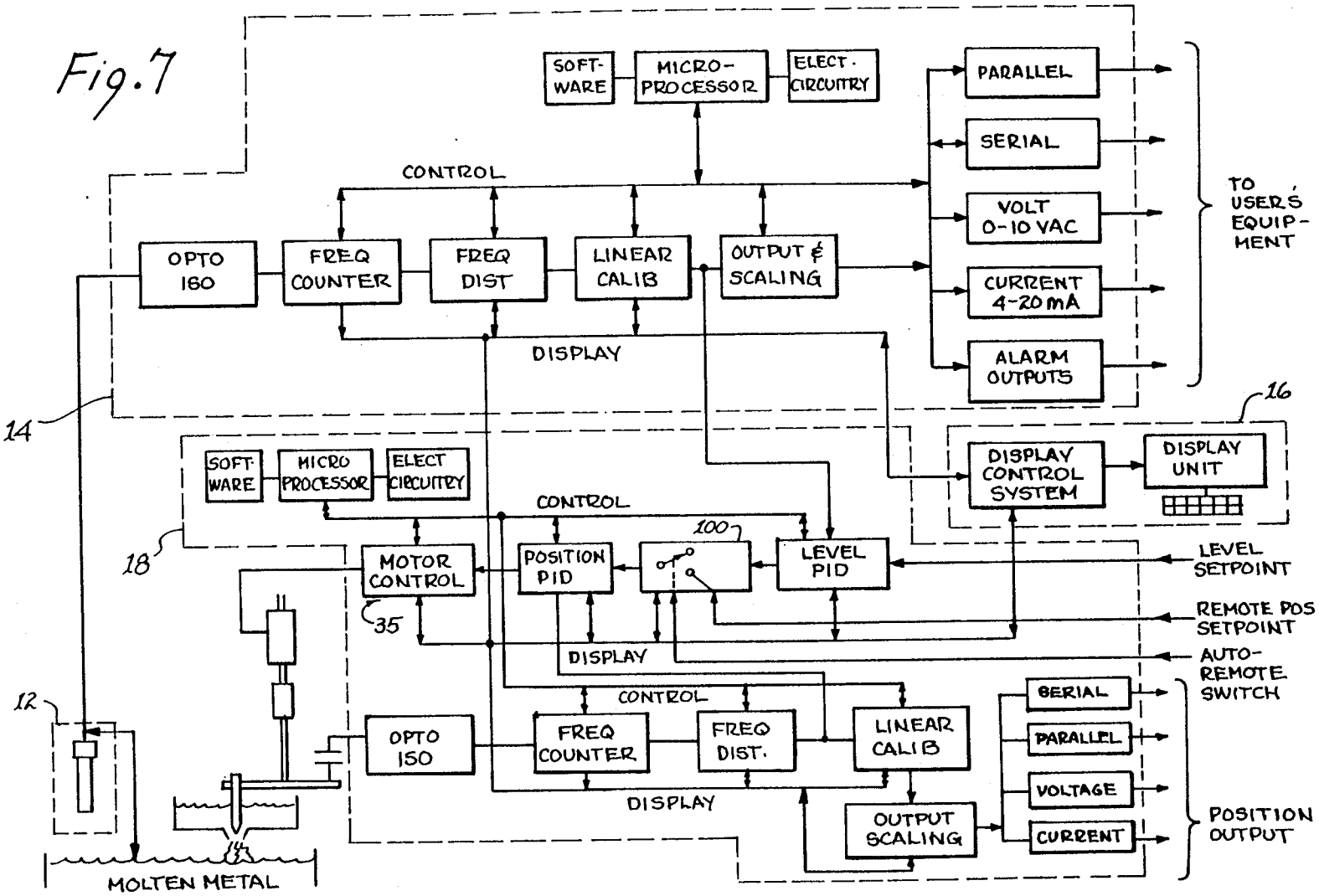
FIG. 7 is a detailed schematic view of the molten metal gauging and control system of FIG. 6 showing a specific implementation of the pin plug positioner system.

FIG. 7 shows the schematic of the second embodiment of the invention, wherein the molten metal control system 18 is a specific type of pin plug positioner system 85.

Figure 10:
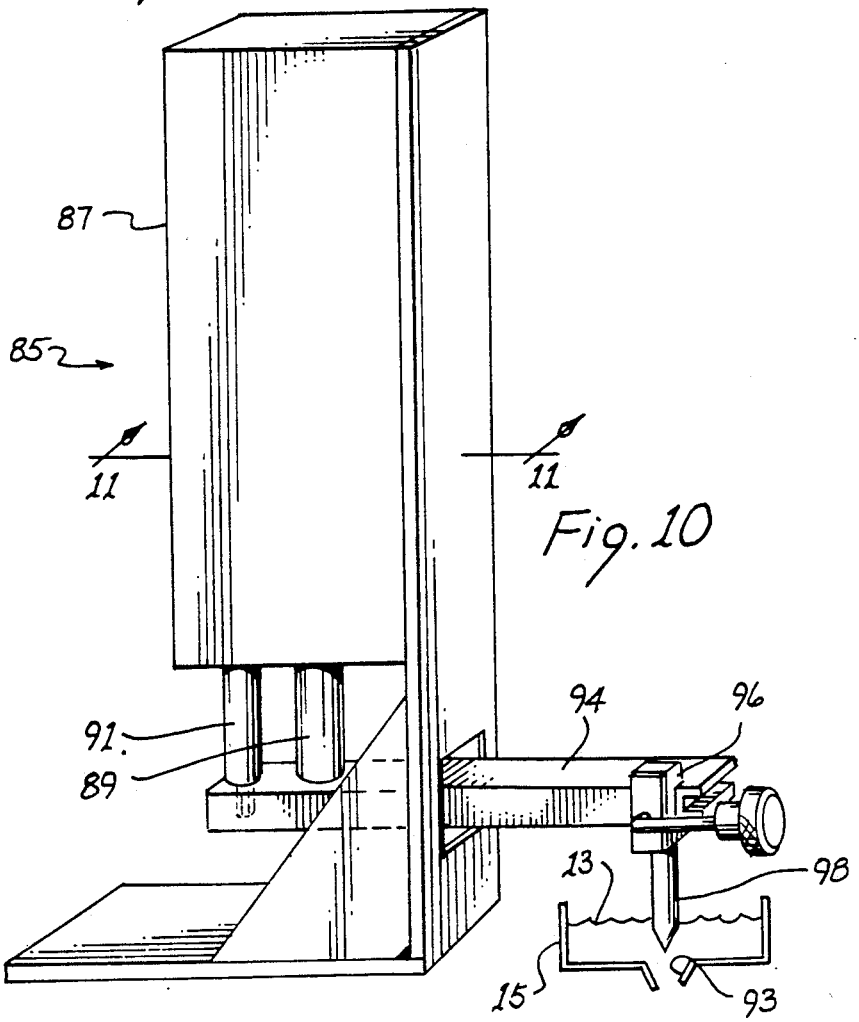
FIG. 10 is a perspective view of one specific implementation of the pin plug positioner system shown in FIG. 7.

As shown in FIG. 7, various inputs are provided to the display control system and various outputs from the display control system are provided to the function features coupled to the display control system. As shown in FIG. 10, this pin plug positioner system 85 includes a linear actuator and sensor assembly 87 which moves a linear actuator shaft 89, which moves clamp arm 94, thereby moving sensor shaft 91 and clamp assembly 96 with attached tapered pin plug 98. The tapered pin plug 98 has a corresponding tapered hole 93 in container 15 for controlling the flow of molten metal 13 out of container 15.

Figure 11:
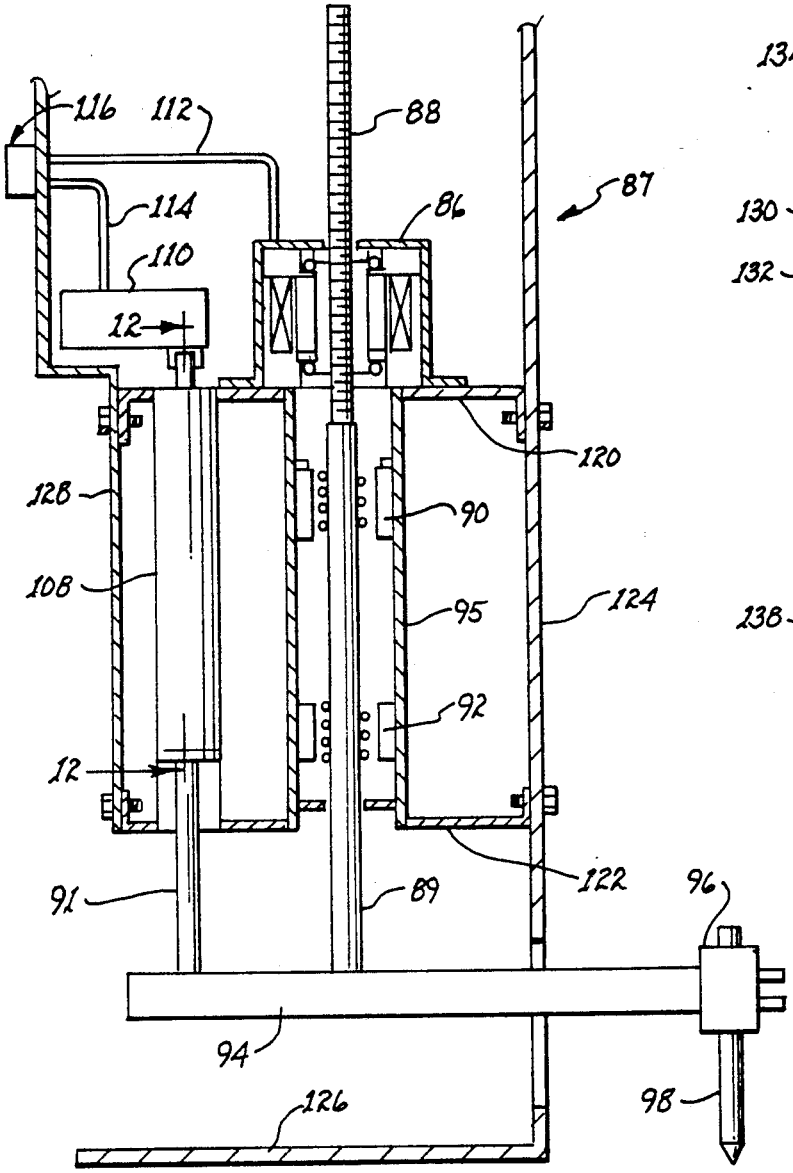
FIG. 11 is a cross sectional view of the pin plug positioner in FIG. 10 along the line 11—11.

FIG. 11 shows a cross sectional view of the linear actuator and sensor assembly 87 shown in FIG. 10. The linear actuator and sensor assembly 87 includes a motor such as a D.C. or stepper motor 86, a lead screw 88 coupled to linear actuator shaft 89, linear bearing assembly 95 with associated linear bearings 90 and 92, capacitance sensing circuitry 110, and a capacitance sensor 108 with corresponding sensor shaft 91. Stepper motor 86 and capacitance sensing circuitry 110 have respective cables 112 and 114 which are connected to connector 116.

Stepper motor 86, linear bearing assembly 95, and capacitance sensor 108 are all fixedly coupled to top plate 120. Linear bearing assembly 95 and capacitance sensor 108 are also fixedly coupled to bottom plate 122. Top plate 120 and bottom plate 122 are both fixedly coupled to side plate 124. Side plate 124 is fixedly coupled to base plate 126, which is fixedly coupled to the molten metal container 15. Top plate 120, bottom plate 122, and connector 116 are all fixedly coupled to cover 128 as shown, which encloses the components of the linear actuator and sensor assembly 87. Linear actuator shaft 89 and sensor shaft 91 are fixedly coupled to clamp arm 94. Clamp assembly 96 is fixedly coupled to clamp arm 94, and is used to attach tapered pin plug 98 to clamp arm 94.

When the position of the tapered pin plug 98 needs to be changed to adjust the level of molten metal 13 in the container 15, the equipment coupled to connector 116 causes the stepper motor 86 to rotate an appropriate number of steps in the appropriate direction. The rotating of the stepper motor 86 causes the lead screw 88 to extend or retract linear actuator shaft 89 depending on the direction of rotation of the stepper motor 86. The tapered pin plug 98 and sensor shaft 91 both move as the linear actuator shaft 89 moves, since all three are rigidly coupled to clamp arm 94. The movement of tapered pin plug 98 increases or decreases the flow of molten metal 13 out of container 15 by increasing or decreasing the distance between the tapered pin plug 98 and the corresponding tapered hole 93 in the container 15 (See FIG. 10).

As shown in FIG. 7, the 0 to 100% scaled output of the transmitter 14 is used by the pin plug positioner system 85. This signal is input with a corresponding set point to a level Proportional Integral Derivative (PID) algorithm in the pin plug positioner system 85, which determines the setpoint for the tapered pin plug 98 (see FIG. 11). Note that switch 100 is provided to override the level output and position setpoint to the pin plus positioner control function to allow external control of the pin plus position for open loop ramping of the metal level.

The measured position of the pin plug 98 is a determined by capacitance sensor 108. In this case the capacitance sensor 108 provides the a digital output frequency proportional to capacitance and, after conversion to distance, linearization, and scaling to reflect the measured pin plug position. The measured position is compared with the position set point and through a PIN PID control algorithm an output signal is sent to the motor controller to position the tapered pin plug 98 in the proper position to maintain the correct molten metal level.

Capacitance sensor 108 (see FIG. 11) is capable of detecting a missed step of the stepper motor 86. Sensing the actual steps of the stepper motor 86 allows modulating the power to the stepper motor 86 to substantially reduce its current drive requirements and thereby proportionally reduce heat dissipation, which extends the life of stepper motor 86.

Figure 12:
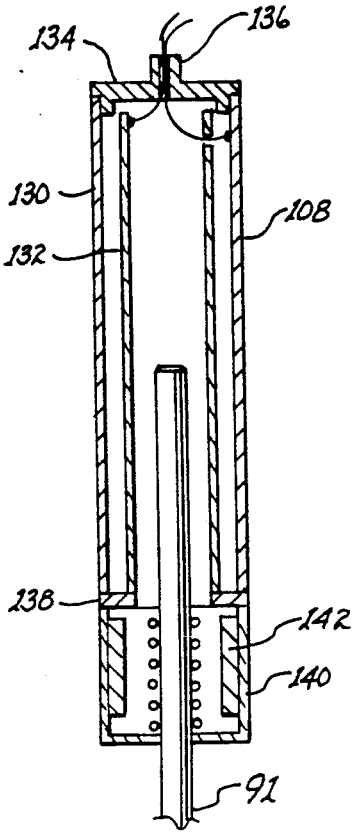
FIG. 12 is a cross sectional view of the capacitance sensor used in the pin plug positioner system of FIG. 11 along the line 12—12.
Figure 13:
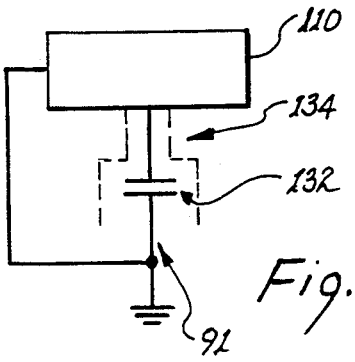
FIG. 13 is a schematic drawing showing the equivalent circuit for the capacitance sensor used in the pin plug positioner of FIG. 11.

FIG. 12 shows a cross sectional view of the capacitance sensor 108 used in the linear actuator and sensor assembly 87 shown in FIG. 11. The capacitance sensor 108 has an outer tube 130, a sensing tube 132, an insulator cap 134, a two conductor connector 136, an insulator ring 138, a bearing tube 140, a linear bearing 142, and a sensor shaft 91. The sensor shaft 91 passes through the linear bearing 142 and into the sensing tube 132. Capacitance sensing circuitry 110 is connected to capacitance sensor 108 using the two conductor connector 136 shown. As shown in FIG. 13, one conductor of the two conductor connector 136 is connected to the sensing tube 132, providing one "plate" of the capacitor. The second "plate" of the capacitor is the sensor shaft 91. As the sensor shaft moves into or out of the sensing tube 132, the capacitance changes, which change can be converted to distance that the sensor shaft 91 moved, which corresponds to the distance the tapered plug pin 98 moved. The outer tube 130 is electrically connected to the capacitance sensing circuitry 110 and driven to the same potential as sensing tube 132, thereby providing an electrical shield to protect against the effects of stray capacitance introduced by surrounding objects.

Figure 8:
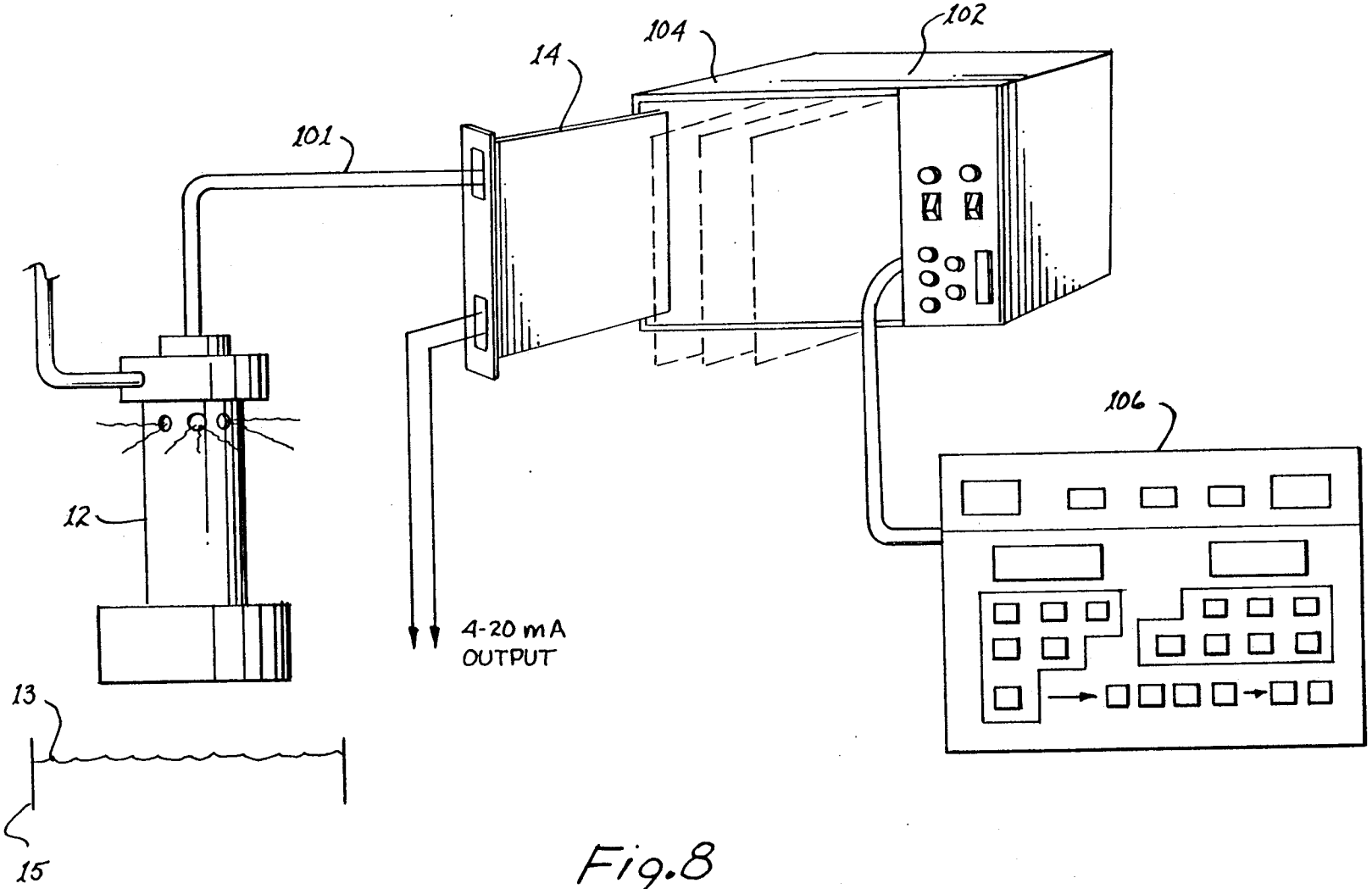
FIG. 8 is a schematic representation of the molten metal gauging and control system of FIG. 1 showing the modular architecture used.

FIG. 8 shows one specific implementation of the molten metal gauging and control system shown in FIG. 1. A capacitance sensor 12 is used to sense the level of molten metal 13 in container 15. This level is communicated to the transmitter 14 via a cable 101. The transmitter is mounted in a card rack 104 with a backplane (not shown) that allows easily connecting a display controller 102 to the transmitter 14. Display controller 102 is coupled to a display device or terminal 106 to allow an operator to monitor the molten metal process. Transmitter 14 supplies the scaled level output in many forms, such as a parallel digital word, an analog voltage, or as 4–20 mA current loop output specifically shown in FIG. 8. The molten metal control system 18 can use the output available from the transmitter 14 (see FIG. 7) as an input to adjust the flow of molten metal 13 into the container 15.

While the invention has been described in its preferred embodiments, it is to be understood that the words which have been used are words of description rather than limitation, and that changes may be made within the purview of the appended claims without departing from the true scope and spirit of the invention in its broader aspects. For example, the capacitance sensor may contain electronics which can linearize the output of the capacitance sensor over the entire desired operating range of molten metal levels. The capacitance sensor may also contain electronics which define a communication protocol for exchanging digital information with the transmitter. Therefore, the output of the capacitance sensor 12 can selectively provide a digital output frequency which changes frequency as the sensed capacitance changes, an electrical output that is an analog voltage which changes when the sensed capacitance changes, an electrical output that is a parallel digital word which changes when the sensed capacitance changes, and an electrical output that is a serial digital word which change when the sensed capacitance changes. This communication protocol could be used to daisy chain several capacitance sensors to one single transmitter. Another example is the integration of the transmitter function 14, level controller functions, pin position controller functions 18 and motor drive functions 85 into a single electronic control circuit with multiple input/output channels.

I claim:

1. A system for gauging the level of molten metal within at least one container, comprising:

at least one capacitance sensor comprising:

a substantially flat-plate electrode rigidly mounted to said container above the level of said molten metal to establish a variable capacitance between the electrode and the molten metal;

a conductive housing disposed adjacent said electrode, said conductive housing and said electrode being driven to a common potential; and means for detecting changes in said variable capacitance resulting from changes in the level of said molten metal and producing an electrical output corresponding to said level; and converter circuitry electrically coupled to said electrode and said molten metal for converting said electrical output of said capacitance sensor to a linear output signal; and display circuitry for displaying said linear output signal as the level of said molten metal..

2. The system of claim 1 wherein said capacitance sensor comprises an enclosure with circuitry therein that detects a change in capacitance between a sensor plate located on the bottom face of said capacitance sensor and said molten metal which has an electrical connection to said circuitry.

3. The system of claim 2 wherein said electrical connection between said capacitance sensor and said molten metal consists of a wire conductor which couples to said container and to said capacitance sensor in such a way as to assure electrical continuity between said molten metal and said capacitance sensor.

4. The system of claim 2 wherein said electrical connection between said capacitance sensor and said molten metal consists of a mechanical connection between said capacitance sensor and said container.

5. The system of claim 2 wherein said enclosure is actively driven to the same electrical potential as said sensor plate to provide an electrical shield.

6. The system of claim 1 wherein said electrical output of the capacitance sensor is a digital output frequency which changes frequency as the sensed capacitance changes.

7. The system of claim 1 wherein said electrical output of the capacitance sensor is an analog voltage which changes when the sensed capacitance changes.

8. The system of claim 1 wherein said electrical output of the capacitance sensor is a parallel digital word which changes when the sensed capacitance changes.

9. The system of claim 1 wherein said electrical output of the capacitance sensor is a serial digital word which changes when the sensed capacitance changes.

10. The system of claim 1 wherein said capacitance sensor has cooling means for maintaining the temperature of said circuitry within said capacitance sensor at a reasonable operating temperature.

11. The system of claim 10 wherein said cooling means comprises a fluid passing from at least one input port on said capacitance sensor, past said circuitry internal to said capacitance sensor, and out through at least one output port on said capacitance sensor.

12. The system of claim 11 wherein said fluid is a compressed gas.

13. The system of claim 11 wherein said fluid is a liquid.

14. The system of claim 1 wherein said electrical output of said capacitance sensor is electrically isolated from said converter circuitry using at least one optical isolator.

15. The system of claim 1 wherein said converter circuitry includes a microprocessor.

16. The system of claim 15 wherein said software converts the nonlinear response of said electrical output of said capacitance sensor to a substantially linear output corresponding to the distance between said capacitor sensor and said molten metal.

17. The system of claim 1 wherein said converter circuitry has an output that is a digital frequency which changes as said electrical output of said capacitance sensor changes.

18. The system of claim 1 wherein said converter circuitry has an output that is an analog voltage which changes as said electrical output of said capacitance sensor changes.

19. The system of claim 1 wherein said converter circuitry has an output that is a parallel digital word which changes as said electrical output of said capacitance sensor changes.

20. The system of claim 1 wherein said converter circuitry has an output that is a serial digital word which changes as said electrical output of said capacitance sensor changes.

21. The system of claim 1 wherein said converter circuitry has at least one discrete output corresponding to an alarm signal which occurs when a condition is detected within said converter means that is outside a range of desired tolerances.

22. The system of claim 1 further comprising a display system coupled to said converter means.

23. The system of claim 22 wherein said display system comprises a plurality of keys with a monitor device.

24. The system of claim 23 wherein said plurality of keys is used to enter appropriate control information into said converter circuitry, and said monitor device is used to indicate the status of said capacitance sensor, said converter circuitry, and said display system.

25. The system of claim 2 wherein said circuitry in said capacitance sensor has linearization means for correcting the inherent nonlinearities of said capacitance sensor as the distance between said capacitance sensor and said molten metal increases, and providing a substantially linear output over the desired range of molten metal levels to be measured.

26. The system of claim 3 wherein said circuitry in said capacitance sensor has a microprocessor.

27. The system of claim 2 wherein said circuitry in said capacitance sensor has a defined protocol for transmitting the output of said capacitance sensor to said converter circuitry.

28. A system for gauging and controlling the level of molten metal, within at least one container, comprising:

at least one capacitance sensor comprising:

a substantially flat-plate electrode fixedly coupled to said container above the level of said molten metal to establish a variable capacitance between the electrode and the molten metal;

a conductive housing disposed adjacent said electrode, said conductive housing and said electrode being driven to a common potential; and means for detecting changes in said variable capacitance resulting from changes in the level of said molten metal and producing an electrical output corresponding to said level;

converter circuitry electrically coupled to said electrode and said molten metal for converting said electrical output of said capacitance sensor to a linear output signal;

display circuitry for displaying said linear output as the level of said molten metal; and control circuitry for controlling the flow of molten metal into or out of said container in response to said linear output signal.

29. The system of claim 28 wherein said container has a bracket fixedly coupled thereto whereon said capacitance sensor is fixedly coupled.

30. The system of claim 28 wherein said capacitance sensor comprises an enclosure with circuitry therein that detects a change in capacitance between a sensor plate located on the bottom face of said enclosure and said molten metal which has an electrical connection to said circuitry.

31. The system of claim 30 wherein said electrical connection between said capacitance sensor and said molten metal consists of a wire conductor which couples to said container and to said capacitance sensor in such a way as to assure electrical continuity between said molten metal and said capacitance sensor.

32. The system of claim 30 wherein said electrical connection between said capacitance sensor and said molten metal consists of a mechanical connection between said capacitance sensor and said container.

33. The system of claim 30 wherein said enclosure is actively driven to the same electrical potential as said sensor plate to provide an electrical shielding effect from Electro Magnetic Interference (EMI).

34. The system of claim 28 wherein said electrical output of the capacitance sensor is a digital output frequency which changes frequency as the sensed capacitance changes.

35. The system of claim 28 wherein said electrical output of the capacitance sensor is an analog voltage which changes when the sensed capacitance changes.

36. The system of claim 28 wherein said electrical output of the capacitance sensor is a parallel digital word which changes when the sensed capacitance changes.

37. The system of claim 28 wherein said electrical output of the capacitance sensor is a serial digital word which changes when the sensed capacitance changes.

38. The system of claim 28 wherein said capacitance sensor has cooling means for maintaining the temperature of said circuitry within said capacitance sensor at a reasonable operating temperature.

39. The system of claim 38 wherein said cooling means comprises a fluid passing from at least one input port on said capacitance sensor, past said circuitry internal to said capacitance sensor, and out through at least one output port on said capacitance sensor.

40. The system of claim 39 wherein said fluid is a compressed gas.

41. The system of claim 39 wherein said fluid is a liquid.

42. The system of claim 28 wherein said electrical output of said capacitance sensor is electrically isolated from said converter means using at least one optical isolator.

43. The system of claim 29 wherein said converter circuitry has a microprocessor.

44. The system of claim 43 wherein said software converts the nonlinear response of said electrical output of said capacitance sensor to a substantially linear output corresponding to the distance between said capacitance sensor and said molten metal.

45. The system of claim 28 wherein said converter circuitry has an output that is a digital frequency which changes as said electrical output of said capacitance sensor changes.

46. The system of claim 28 wherein said converter circuitry has an output that is an analog voltage which changes as said electrical output of said capacitance sensor changes.

47. The system of claim 28 wherein said converter circuitry has an output that is a parallel digital word which changes as said electrical output of said capacitance sensor changes.

48. The system of claim 28 wherein said converter circuitry has an output that is a serial digital word which changes as said electrical output of said capacitance sensor changes.

49. The system of claim 28 wherein said converter circuitry has at least one discrete output corresponding to an alarm signal which occurs when a condition is detected within said converter circuitry that is outside a range of desired tolerances.

50. The system of claim 28 further comprising a display system coupled to said converter circuitry.

51. The system of claim 50 wherein said display system comprises a plurality of keys with a monitor device.

52. The system of claim 51 wherein said plurality of keys is used to enter appropriate control information into said converter circuitry, and said monitor device is used to indicate the status of said capacitance sensor, said converter circuitry, and said display system.

53. The system of claim 30 wherein said circuitry in said capacitance sensor has linearization means for correcting the nonlinearities of said capacitance sensor as the distance between said capacitance sensor and said molten metal increases, and providing a substantially linear output over the desired range of molten metal levels to be measured.

54. The system of claim 30 wherein said circuitry in said capacitance sensor has a microprocessor.

55. The system of claim 30 wherein said circuitry in said capacitance sensor has a defined protocol for transmitting the output of said capacitance sensor to said converter circuitry.

56. The system of claim 28 wherein said control circuitry comprises, in combination:

Proportional Integral Derivative (PID) processor;

electrical molten metal level input to said PID processor;

electrical setpoint input to said PID processor;

motor controller circuitry controlled by the output of said PID processor;

tapered pin positioner with electrical connections to said motor controller circuitry; and second converter circuitry for converting the output of said tapered pin positioner to a position parameter.

57. The system of claim 56 wherein said tapered pin positioner comprises, in combination:

a base plate for coupling said control means to said container;

a side plate fixedly coupled to said bottom plate;

a top plate fixedly coupled to said side plate;

a cover coupled to said top plate and to said bottom plate;

a linear actuator with attached actuator shaft coupled to said top plate and to said bottom plate;

a position sensor coupled to said top plate and to said bottom plate;

an actuator arm fixedly coupled to said actuator shaft;

a clamp fixedly coupled to said actuator arm; and a tapered pin plug coupled to said actuator arm using said clamp.

58. The system of claim 57 wherein said linear actuator comprises, in combination:

a motor having a screw mechanism with internal threads that rotate as said stepper motor rotates;

a lead screw with external threads which engage said internal threads of said screw mechanism on said motor, which lead screw is fixedly coupled to said actuator shaft in such a manner as to cause linear movement of said actuator shaft when said motor rotates; and at least one linear bearing assembly through which said actuator shaft passes, which bearing assembly reduced considerably the sideloading on said motor.

59. The system of claim 57 wherein said position sensor comprises a second capacitance sensor with an electrical output proportional to sensed capacitance.

60. The system of claim 59 wherein said second capacitance sensor comprises, in combination:

an outside metal tubular enclosure;

a multiple conductor connector fixedly coupled to said tubular enclosure at one end of said tubular enclosure;

capacitance sensing circuitry having an output proportional to sensed capacitance which is electrically connected to said multiple conductor connector;

a sensing tube within said tubular enclosure with electrical connection to said multiple conductor connector such that said sensing tube forms one plate surface for the capacitance sensed by said capacitance sensing circuitry;

a linear bearing assembly fixedly coupled to said tubular enclosure at the end opposite said multiple conductor connector; and a sensor shaft fixedly coupled to said actuator arm which passes through said linear bearing assembly into the interior of said sensing tube, with electrical connection to said capacitance sensing circuitry such that said sensor shaft forms the second plate surface for the capacitance sensed by said capacitance sensing circuitry.

61. The system of claim 56 wherein said second converter circuitry has an electrical output that is a digital output frequency which changes frequency as the sensed capacitance changes.

62. The system of claim 56 wherein said second converter circuitry has an electrical output that is an analog voltage which changes when the sensed capacitance changes.

63. The system of claim 56 wherein said second converter circuitry has an electrical output that is a parallel digital word which changes when the second capacitance changes.

64. The system of claim 56 wherein said second converter circuitry has an electrical output that is a serial digital word which changes when the sensed capacitance changes.

65. The system of claim 60 wherein said tubular enclosure has an electrical connection to said multiple conductor connected to provide an electrical shield of said sensing tube.

66. The system of claim 57 wherein said linear actuator and said position sensor both have electrical connections to a single connector attached to said cover.

67. The system of claim 56 wherein said motor controller circuitry has means for increasing and decreasing at least one of the speed and the power delivered to said tapered pin positioner means.

68. A method of gauging the level of molten metal in at least one container, comprising the steps of:

fixedly coupling at least one capacitance sensor having a substantially flat-plate electrode to said container above the level of said molten metal to establish a variable capacitance between the electrode and the molten metal;

providing a conductive housing adjacent said electrode and driving said housing and said electrode to a common potential;

detecting changes in said variable capacitance resulting from changes in the level of said molten metal and producing an electrical output corresponding to said level;

converting said electrical output of said capacitance sensor to a linear output signal; and displaying said linear output signal as the level of said molten metal.

69. The method of claim 68 wherein the step of converting the electrical output is performed by a microprocessor which converts the nonlinear response to said electrical output of said capacitance sensor to a substantially linear output corresponding to the distance between said capacitance sensor and said molten metal.

70. The method of claim 68 wherein said converter circuitry generates at least one discrete output corresponding to an alarm signal which occurs when a condition is detected within said converter circuitry that is outside a range of desired tolerances.

71. The method of claim 68 further comprising the step of displaying the output converted by said converter circuitry.

72. The method of claim 71 wherein appropriate control information is entered into said converter circuitry through a plurality of keys, and the status of said capacitance sensor and said converter circuitry are indicated on a monitor associated with said keys.

73. A method for gauging and controlling the level of molten metal in at least one container, comprising the steps of:

fixedly coupling at least one capacitance sensor having a substantially flat-plate electrode to said container above the level of said molten metal to establish a variable capacitance between the electrode and the molten metal;

providing a conductive housing adjacent said electrode and driving said housing and said electrode to a common potential;

detecting changes in said variable capacitance resulting from changes in the level of said molten metal and producing an electrical output corresponding to said level;

converting said electrical output of said capacitance sensor to a linear output signal;

displaying said linear output signal as the level of said molten metal; and controlling the flow of molten metal into or out of said container in response to said linear output signal.

74. The method of claim 73 wherein:

said converting step is performed by a microprocessor which converts the nonlinear response of said electrical output of said capacitance sensor to a substantially linear output corresponding to the distance between said capacitance sensor and said molten metal.

75. The method of claim 73 wherein said converter circuitry generates at least one discrete output corresponding to an alarm signal which occurs when a condition is detected within said converter circuitry that is outside a range of desired tolerances.

76. The method of claim 73 further comprising the step of displaying the electrical output converted by said converter circuitry.

77. The method of claim 76 wherein appropriate control information is entered into said converter circuitry through a plurality of keys, and the status of said capacitance sensor and said converter circuitry are indicated on a monitor associated with said keys.

78. The method of claim 73 wherein the step of controlling the flow of molten metal comprises:

providing a Proportional Integral Derivative (PID) processor;

applying an electrical molten metal level output of said converter circuitry to said PID processor;

applying an electrical setpoint input to said PID processor;

controlling a tapered pin positioner in response to the output of said PID processor; and converting the output of said tapered pin positioner means to a position parameter.

79. The method of claim 78 further comprising the steps of:

converting said output of said capacitance sensor to a scaled, linear response using said converter circuitry;

providing said scaled, linear output in at least one form which can be used by external equipment comparing said scaled, linear output of said capacitance sensor which represents molten metal level to a desired molten metal level;

computing a new electrical setpoint input to compensate for changing molten metal levels;

activating said tapered pin positioner to position a tapered pin plug to said new setpoint;

converting said output of said position sensor to a scaled, linear response;

providing said scaled, linear output in at least one form which can be used by external equipment comparing the position indicated by said scaled, linear output with said new setpoint; and if said position differs from said new setpoint, incrementally increasing power to said tapered pin positioner and repeating the sequence of controlling said tapered pin positioner until the tapered pin positioner has in fact moved the desired distance.

* * * * *

UNITED STATES PATENT AND TRADEMARK OFFICE

CERTIFICATE OF CORRECTION

PATENT NO. : 5,298,887

DATED : March 29, 1994

INVENTOR(S) : Roger A. Pepping

It is certified that error appears in the above-identified patent and that said Letters Patent is hereby corrected as shown below:

Column 13, line 17, delete "3" and substitute therefor "2";

Column 15, line 32, "a bottom plate fixedly coupled to said side plate;" should be inserted after "side plate;"

Column 16, line 28, delete "second" and substitute therefor "sensed";

Column 16, line 36, delete "connected" and substitute therefor "connector";

Column 16, line 65, delete "to" and substitute therefor "of";

Column 18, line 40, following "equipment", insert ";".

Signed and Sealed this

Twenty-sixth Day of July, 1994

*Attest:*

*Attesting Officer*

BRUCE LEHMAN

*Commissioner of Patents and Trademarks*